US005488977A

United States Patent [19]

Vinciguerra

[11] Patent Number: 5,488,977

[45] Date of Patent: Feb. 6, 1996

[54] ELECTROMAGNET-STRIKER BAR SYSTEM FOR A ROTARY DOBBY DRIVE DEVICE

[75] Inventor: Costantino Vinciguerra, Florence, Italy

[73] Assignee: Nuovo Pignone S.p.A., Florence, Italy

[21] Appl. No.: 343,871

[22] Filed: Nov. 17, 1994

[30] Foreign Application Priority Data

Nov. 19, 1993 [IT] Italy ..... MI93A2457

[51] Int. Cl.[6] ..... D03C 1/00

[52] U.S. Cl. ..... 139/455; 139/66 R; 139/76

[58] Field of Search ..... 139/455, 66 R, 139/76

[56] References Cited

U.S. PATENT DOCUMENTS

| | | | |
|---|---|---|---|
| 4,377,799 | 3/1983 | Froment . | |
| 4,461,325 | 7/1984 | Palau et al. | 139/66 R X |
| 5,125,435 | 6/1992 | Froment | 139/66 R |
| 5,174,342 | 12/1992 | Vinciguerra | 139/76 |
| 5,259,419 | 11/1993 | Vinciguerra et al. | 139/455 |

FOREIGN PATENT DOCUMENTS

| | | | |
|---|---|---|---|
| 0079843 | 5/1983 | European Pat. Off. . | |
| 0525862 | 2/1993 | European Pat. Off. . | |
| 2530678 | 1/1984 | France . | |
| 3502850 | 8/1985 | Germany | 139/76 |

*Primary Examiner*—Andy Falik

*Attorney, Agent, or Firm*—Oblon, Spivak, McClelland, Maier & Neustadt

[57] ABSTRACT

An electromagnet-striker bar system for the control device of a rotary dobby includes an amagnetic container having an extremely rigid box structure into which the iron cores of the electromagnets are equidistantly inserted and irreversibly locked. Amagnetic spools for supporting the electrical windings are mounted on electromagnetic pole pieces. The container is provided, in that side further from the hinging axis of said striker bars, with a longitudinal groove into which are inserted the amagnetic support and slide shoulders for the free ends of the striker bars. The free ends of the striker bars are hardened by heat treatment.

7 Claims, 3 Drawing Sheets

ELECTROMAGNET-STRIKER BAR SYSTEM FOR A ROTARY DOBBY DRIVE DEVICE

BACKGROUND OF THE INVENTION

1. Field of the Invention

This invention relates to a new electromagnet-striker bar system for a rotary dobby control device which, by considerably reducing wear between the ferrous material striker bars and the relative amagnetic support and slide shoulders and always ensuring a constant optimum predetermined value for the air gap between the electromagnets and said striker bars, results not only in large constructional economy but also in considerable operational safety and reliability with time, as required by modern high-speed rotary dobbies.

More precisely, the invention relates to an improvement in the electromagnet packs used in the two identical control units of the rotary dobby control device, as described in European patent application publication No. 0525862 in the name of the present applicant.

2. Discussion of Background

As known from the above European application, each control unit comprises a set of striker bars of ferrous material equal in number to the number of main crank arms in the dobby, which can be twenty or more in number, each bar being urged by its individual spring against an accompanying arm which rotates it from a first position in which it cooperates with the control pusher of its individual operating unit to a second position in which it cooperates with its individual electromagnet energized in accordance with a predetermined program. All of the striker bars are hinged at one of their ends to their individual arm projecting from a single shaft which rocks them in a direction perpendicular to this shaft. To prevent this rocking of the bars causing undesirable sliding or deleterious contact of the bars against their electromagnets when the bars are retained in the second position by the respective energized electromagnets, each striker bar, when in the second position, is in contact with an amagnetic support and slide shoulder interposed between the pole pieces of the electromagnets in order to create a very small air gap between the bar and the relative electromagnet.

In this known construction problems have arisen due substantially to too rapid wear of the sliding region between each striker bar and the relative amagnetic shoulder and to the considerable difficulty of maintaining all the striker bars attracted by the relative electromagnets as far as a precise and very small distance from the pole pieces of the electromagnets.

In this respect, as the amagnetic support and slide shoulders are made to act centrally between the pole pieces of each electromagnet, there is no possibility of hardening the contact surfaces to reduce wear, given that any heat treatment of the striker bars would generate a residual magnetism in the bars, compromising proper operation of the dobby in that the residual magnetism would maintain the bars attracted to the relative shoulders even after the energization current of the relative electromagnets is cut off.

Again, for perfect operation the striker bar attracted by the relative electromagnet must always be maintained at a precise optimum minimum distance from the pole pieces of the electromagnet, i.e. a minimum air gap must be created which has been found experimentally to be of the order of about 0.2 millimeters. In this respect a greater minimum air gap would drastically reduce the magnetic attraction of the electromagnet, with the danger that this latter attraction is no longer able to overcome the action of the reaction spring of the striker bar, which would therefore be withdrawn from the relative shoulder even though the electromagnet is energized.

A zero air gap is also deleterious and disastrous in that a residual magnetism would be created in the striker bar of such intensity that the reaction spring would no longer be able to detach the bar from the relative shoulder when the electromagnet is de-energized.

Finally a minimum air gap less than the optimum value would result in a very large force of attraction with consequent increase in wear.

As currently the electromagnet pack is generally formed by stacking the relative magnetic cores using two locking ties which pass through holes in the cores and are locked at their ends by shoulder bolts to form a structure which is not perfectly rigid, it is clearly extremely difficult if not impossible to maintain the predetermined value for the air gap with time in the case of all the pairs of striker bars and electromagnets, which can be twenty or more in number.

Again, the inevitable constructional imperfections of the various constituent elements of the electromagnet pack make it even more difficult and costly to achieve the very small air gap.

SUMMARY OF THE INVENTION

The object of the present invention is to obviate the above drawbacks by providing an electromagnet-striker bar system for the control device of a rotary dobby which in addition to drastically reducing wear due to the sliding between the striker bars and the relative amagnetic shoulders, also provides considerable safety and reliability of operation with time by ensuring a constant optimum minimum air gap between said striker bars and the pole pieces of the relative electromagnets.

The above object is substantially attained in that instead of being interposed centrally between the electromagnet pole pieces, the amagnetic support and slide shoulders are now positioned external to the electromagnets and are inserted into a longitudinal groove formed in that side of an electromagnet container which is further from the hinging axis of the striker bars.

In this manner, having moved the sliding region to that end of the striker bar which is further from the hinging axis, not only does it now become possible to harden the end by heat treatment with absolute certainty of absence of residual magnetism within that central region of the striker bars opposite the electromagnet pole pieces, but the bearing forces of the striker bars on the relative shoulders and hence the friction force determining wear now become minimal, since the bearing forces now act at maximum distance from the hinging axis.

The electromagnet container is formed with an extremely rigid amagnetic box structure, preferably of aluminium, within which the iron cores supporting the electrical windings of the electromagnets are equidistantly inserted and irreversibly locked. The amagnetic support and slide shoulders are inserted into a longitudinal groove in that side of the structure further from the hinging axis of the striker bars, as as already stated. In this manner a unit is obtained which, without the use of spacers, welds, screws or adhesives which could be the cause of magnetic interference between the various electromagnets and a source of constructional complications, constitutes a very rigid structure of maximum constructional simplicity and hence economy, which when completely assembled enables all the ends of the magnetic core pole pieces and the upper slide surface of the support and slide shoulders to be subjected simultaneously to final grinding until the desired very small constant air gap is obtained between the striker bars and the relative pole pieces of all the electromagnets of the pack.

Hence, the electromagnet-striker bar system for the control device of a rotary dobby includes a set of striker bars of ferrous material which are hinged at one of their ends to their individual arm projecting from a single shaft which rocks them. Each striker bar is urged by an individual spring against a single accompanying arm which rotates them. The striker bars thus move perpendicular to the rocking motion, from a position in which they are in contact with their individual amagnetic support and slide shoulder and cooperate with their individual electromagnet energizable in accordance with a predetermined program, to a position in which they are withdrawn from their the electromagnetics. In accordance with the present invention, the iron cores of the electromagnets are equidistantly inserted into and irreversibly locked in an amagnetic container having an extremely rigid box structure which, in that side further from the hinging axis of said striker bars, is provided with a longitudinal groove into which the amagnetic support and slide shoulders are inserted, the free ends of the striker bars being hardened by heat treatment.

According to a preferred embodiment of the present invention, the amagnetic support and slide shoulders consist of a single bar or shoe of antiwear plastics material with high vibration damping characteristics.

According to a further preferred embodiment of the present invention, the amagnetic support and slide shoulders consist of a number of rollers equal to the number of striker bars and constructed of antiwear material of high vibration damping characteristics, they being inserted into corresponding transverse slots provided perpendicular to the longitudinal groove into which the rotation pins of said rollers are inserted and irreversibly locked.

According to a further preferred embodiment of the present invention, the amagnetic container of extremely rigid box structure is formed from an aluminium alloy section bar. According to a further preferred embodiment of the present invention, the iron cores of the electromagnets are irreversibly locked in the amagnetic container by clinching the two inner lateral walls of the container.

According to a further characteristic of the present invention, each of said electrical windings of the electromagnets is mounted on an amagnetic spool which is mounted on a pole piece of said magnetic cores and comprises two guide legs respectively for the inlet and outlet wires of the winding, which are inserted into corresponding holes provided in the base of the amagnetic container of box structure.

In this manner any defective windings can be easily and instantly replaced, with evident cost advantage.

Finally, in order to compensate any constructional errors and hence ensure correct bearing of the hardened ends of all striker bars on the amagnetic shoulders, the accompanying arm is provided at its end with an elastic longitudinal blade. In this manner the elasticity of the blade ensures that correct pressure is obtained on each striker bar.

BRIEF DESCRIPTION OF THE DRAWINGS

The invention will be more apparent with reference to the accompanying drawings, which illustrate a preferred embodiment thereof given by way of non-limiting example in that technical, technological or constructional modifications can be made thereto without leaving the scope of the present invention.

In the drawings.

DESCRIPTION OF THE PREFERRED EMBODIMENTS

Figure 1:
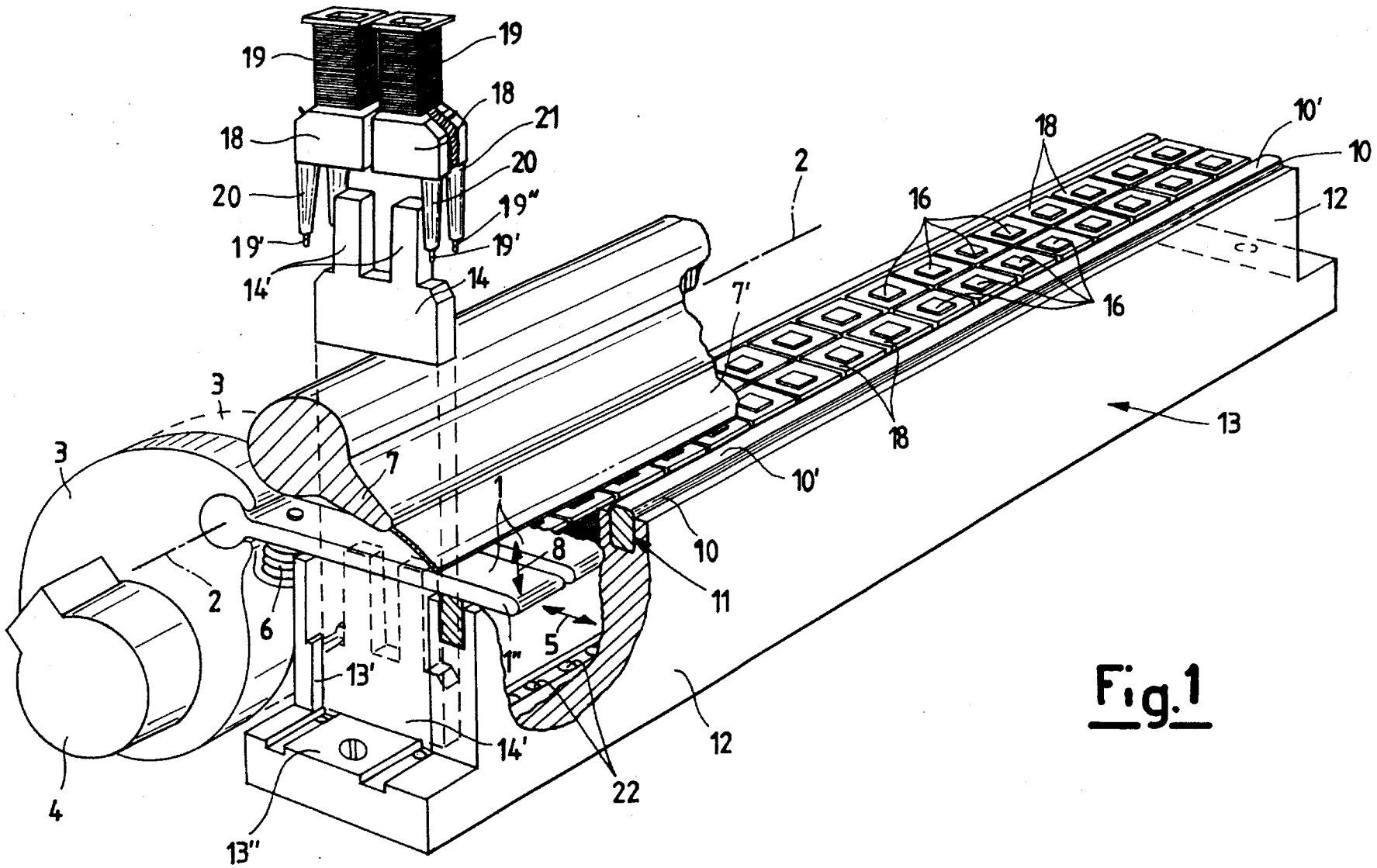
FIG. 1 is a partly sectional perspective exploded view of a control device for a rotary dobby using the electromagnet-striker bar system constructed in accordance with the invention.
Figure 2:
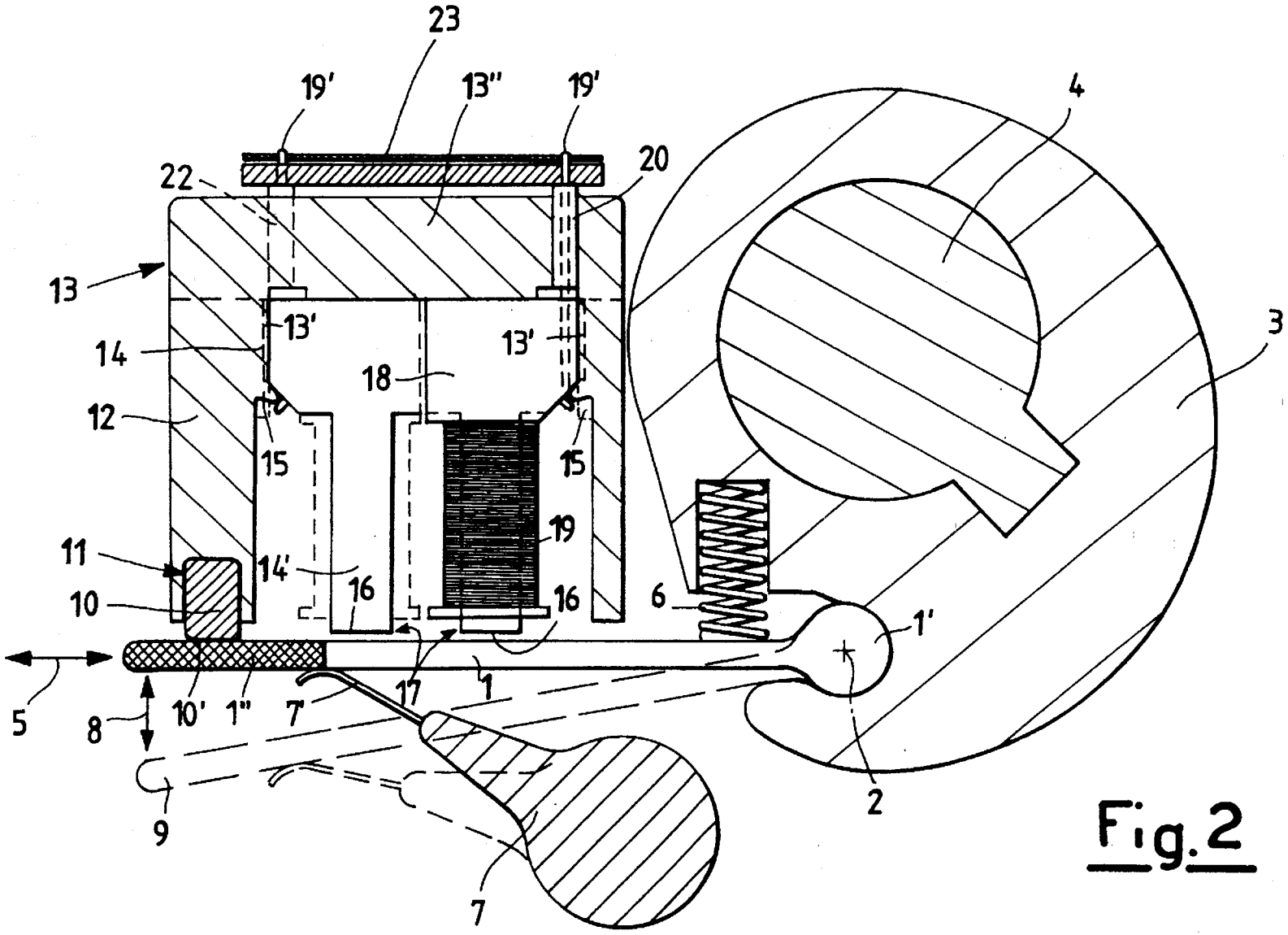
FIG. 2 is a cross-section through FIG. 1 on an enlarged scale.
Figure 3:
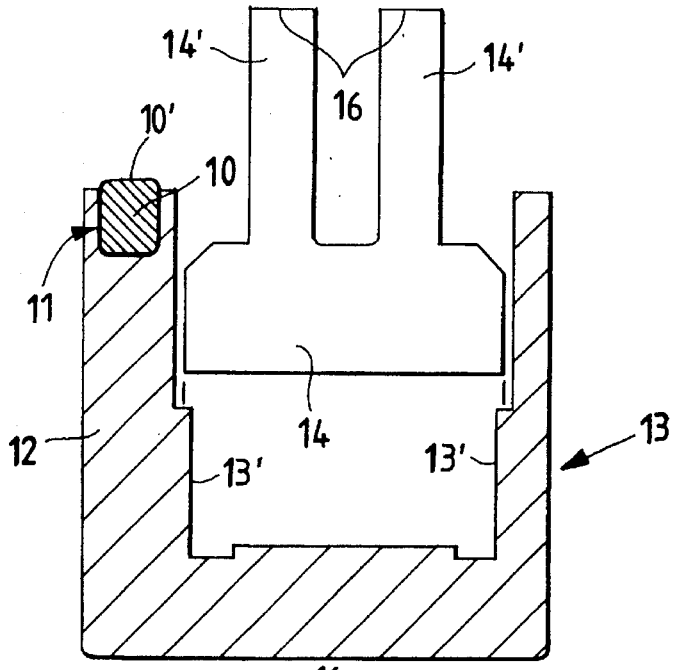
FIGS. 3 and 4 show the operations involved in inserting and irreversibly locking a magnetic core into the container of the system of FIG. 1.
Figure 4:
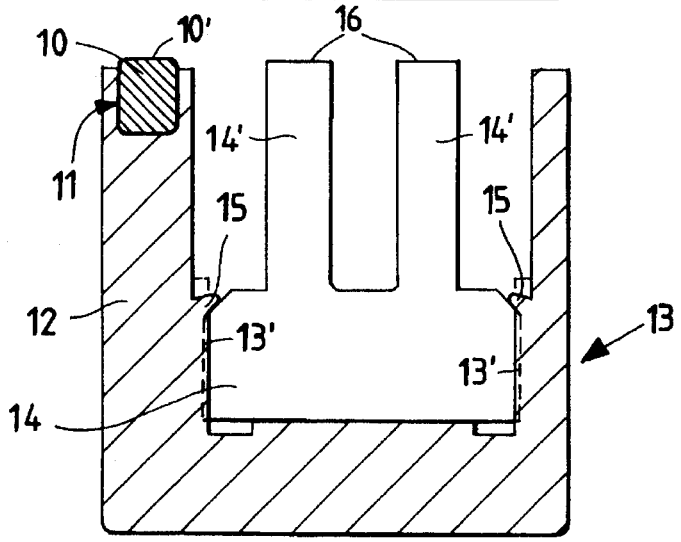

In the figures, the reference numeral 1 indicates the ferrous material striker bars of a rotary dobby control device, hinged at their end 1' on the hinging axis 2 of their arms 3 projecting from a single shaft 4 which rotates to impose on the bars 1 a rocking movement in the direction of the arrows 5. The striker bars 1 are also urged by their individual spring 6 against a single accompanying arm 7 the end of which, in the form of an elastic blade 7', causes them to rotate in accordance with the arrows 8, perpendicular to said movement 5, from the position 9, shown dashed in FIG. 2, to the position shown in full lines in the figures, in which their ends 1", hardened by heat treatment, are in contact with an amagnetic support and slide shoulder 10 consisting of a bar or shoe of antiwear plastics material with high vibration damping characteristics. The shoulder 10 is inserted into a longitudinal groove 11 provided in that side 12 of an amagnetic container 13 of extremely rigid box structure, preferably of aluminium alloy, which is further from the hinging axis 2. The magnetic cores 14 of the electromagnets are inserted into the container 13 and are irreversibly locked in position therein by clinching at 15 (see specifically FIG. 4) the inner lateral walls 13' of the container 13.

After subjecting all the ends 16 of the pole pieces 14' of the magnetic cores 14 and the upper slide surface 10' of the shoulder 10 to final grinding until the desired constant value of the air gap 17 is obtained (see specifically FIG. 2), this now being possible because of the extreme rigidity of the entire assembly, on each of said pole pieces 14' there is mounted an amagnetic spool 18 supporting an electrical winding 19 the inlet wire 19' and outlet wire 19" of which terminate respectively in two guide legs 20 and 21 on the spool 18, these being inserted into corresponding holes 22 provided in the base 13" of the container 13. The wires 19' and 19" emerge from the holes 22 to be connected to a suitable printed circuit 23.

Figure 5:
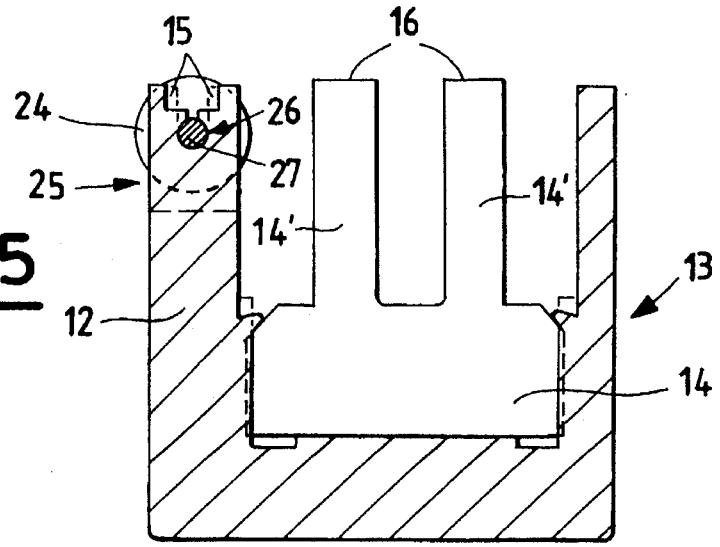
FIG. 5 is a view similar to FIG. 4 showing a modification of the invention.

In the modification shown in FIG. 5, instead of a bar shoulder 10 a number of rollers 24 are used equal to the number of striker bars 1 and constructed of antiwear material of high vibration damping characteristics, they being inserted into corresponding transverse slots 25 provided perpendicular to the longitudinal groove 26 into which the rotation pins 27 of said rollers 24 are inserted and irreversibly locked by clinching at 15.

Obviously, variations and modifications are possible without departing from the teachings of the present invention.

I claim:

1. An electromagnet-striker bar system for the control device of a rotary dobby comprising a set of striker bars of ferrous material, each of the striker bars hinged at one end to a respective individual arm projecting from a single shaft which rocks the individual arms to provide a rocking motion for the striker bars, wherein the striker bars are each urged by a respective individual spring against a single accompanying arm which rotates the striker bars to thereby provide the striker bars with a movement perpendicular to said rocking motion, from a first position in which the striker bars are each in contact with a respective individual amagnetic support and slide shoulder and each of the striker bars cooperate with a respective individual electromagnet energizable in accordance with a predetermined program, to a second position in which the striker bars are each withdrawn from said electromagnets, and wherein iron cores support electrical windings of said electromagnets, with the iron cores equidistantly inserted into and irreversibly locked in an amagnetic container, the amagnetic container having an extremely rigid box structure comprising first and second sides, with the first side further from a hinging axis of said striker bars than said second side, and wherein said first side is provided with a longitudinal groove into which said amagnetic support and slide shoulders are inserted, the striker bars each having a respective free end, and wherein the free ends of the striker bars are hardened by a heat treatment.

2. An electromagnet-striker bar system for the control device of a rotary dobby as recited in claim 1, wherein said amagnetic support and slide shoulders comprise a single bar or shoe of antiwear plastics material with high vibration damping characteristics.

3. An electromagnet-striker bar system for the control device of a rotary dobby as recited in claim 1, wherein said amagnetic support and slide shoulders comprise a number of rollers equal to the number of striker bars and constructed of antiwear material of high vibration damping characteristics, the rollers being inserted into corresponding transverse slots, with the transverse slots perpendicular to said longitudinal groove, and wherein said rollers each have respective rotation pins, and wherein the rotation pins of said rollers are inserted and irreversibly locked in said longitudinal groove.

4. An electromagnet-striker bar system for the control device of a rotary dobby as recited in claim 1, wherein said amagnetic container having an extremely rigid box structure is formed from an aluminum alloy section bar.

5. An electromagnet-striker bar system for the control device of a rotary dobby as recited in claim 1, wherein the amagnetic container includes two inner lateral walls, and said iron cores of the electromagnets are irreversibly locked in the amagnetic container by a clinching structure associated with the two inner lateral walls of said amagnetic container.

6. An electromagnet-striker bar system, for the control device of a rotary dobby as recited in claim 1, wherein each of said electrical windings of the electromagnets is mounted on an amagnetic spool, said spool being mounted on a pole piece of said magnetic cores which comprises two guide legs respectively for the inlet and outlet wires of said winding, said wires being inserted into corresponding holes provided in the base of said amagnetic container.

7. An electromagnet-striker bar system for the control device of a rotary dobby as recited in claim 1, wherein said accompanying arm includes an elastic longitudinal blade.

* * * * *